US007220149B2

(12) United States Patent
Pharney

(10) Patent No.: US 7,220,149 B2
(45) Date of Patent: May 22, 2007

(54) COMMUNICATION PLUG WITH BALANCED WIRING TO REDUCE DIFFERENTIAL TO COMMON MODE CROSSTALK

(75) Inventor: Julian Pharney, Indianapolis, IN (US)

(73) Assignee: CommScope Solutions Properties, LLC, Sparks, NV (US)

( * ) Notice: Subject to any disclaimer, the term of this patent is extended or adjusted under 35 U.S.C. 154(b) by 0 days.

(21) Appl. No.: 11/051,305

(22) Filed: Feb. 4, 2005

(65) Prior Publication Data

US 2006/0121788 A1 Jun. 8, 2006

Related U.S. Application Data

(60) Provisional application No. 60/648,002, filed on Jan. 28, 2005, provisional application No. 60/636,590, filed on Dec. 16, 2004, provisional application No. 60/636,595, filed on Dec. 16, 2004, provisional application No. 60/633,783, filed on Dec. 7, 2004.

(51) Int. Cl.
*H01R 24/00* (2006.01)

(52) U.S. Cl. ..... 439/676

(58) Field of Classification Search ..... 439/676, 439/660, 449, 452, 455–460, 418, 941, 694, 439/894, 404

See application file for complete search history.

(56) References Cited

U.S. PATENT DOCUMENTS 5,186,647 A 2/1993 Denkmann et al.
5,299,956 A 4/1994 Brownell et al.

(Continued)

FOREIGN PATENT DOCUMENTS

DE 196 49 668 5/1998

(Continued)

OTHER PUBLICATIONS

International Search Report and Written Opinion of the International Searching Authority for International Patent Application No. PCT/US2005/037647 mailed on Jun. 1, 2006.

(Continued)

*Primary Examiner*—J. F. Duverne
(74) *Attorney, Agent, or Firm*—Myers Bigel Sibley & Sajovec

(57) ABSTRACT

A communications plug includes: a mounting substrate; a plurality of pairs of output terminals attached to the mounting substrate; and first, second, third and fourth pairs of conductors. The first, second and fourth pairs of the output terminals are arranged in immediately adjacent relationship, and a third pair of output terminals includes output terminals that are separated from each other such that a first output terminal of the third pair is positioned between the first and second pairs of output terminals, and such that a second output terminal of the third pair is positioned between the first and fourth pairs of output terminals. Each of the first, second, third and fourth pairs of conductors is attached for electrical communication with a respective one of the output terminals. The third pair of conductors has at least two locations in which the conductors of the pair cross each other, and is arranged such that, between the crossover locations, the third pair of conductors forms an expanded loop that brings segments of the third conductor into closer proximity to the second and fourth pairs of conductors than to the first pair of conductors.

55 Claims, 12 Drawing Sheets

U.S. PATENT DOCUMENTS 5,310,363 A 5/1994 Brownell et al.
5,326,284 A 7/1994 Bohbot et al.
5,328,390 A 7/1994 Johnston et al.
5,362,257 A 11/1994 Neal et al.
5,397,862 A 3/1995 Bockelman et al.
5,414,393 A 5/1995 Rose et al.
5,432,484 A 7/1995 Klas et al.
5,547,405 A 8/1996 Pinney et al.
5,571,035 A * 11/1996 Ferrill ..... 439/894
5,587,884 A 12/1996 Raman
5,618,185 A 4/1997 Aekins
5,779,503 A 7/1998 Tremblay et al.
5,911,602 A 6/1999 Vaden
5,915,989 A 6/1999 Adriaenssens et al.
5,921,818 A 7/1999 Larsen et al.
5,947,772 A 9/1999 Arnett et al.
5,961,354 A 10/1999 Hashim
5,967,853 A 10/1999 Hashim
5,971,813 A 10/1999 Kunz et al.
5,975,919 A 11/1999 Arnett et al.
5,989,071 A 11/1999 Larsen et al.
5,997,358 A 12/1999 Adriaenssens et al.
6,017,247 A 1/2000 Gwiazdowski
6,042,427 A 3/2000 Adriaenssens et al.
6,050,843 A 4/2000 Adriaenssens et al.
6,102,730 A 8/2000 Kjeldahl et al.
6,116,964 A 9/2000 Goodrich et al.
6,120,330 A 9/2000 Gwiazdowski
6,165,023 A 12/2000 Troutman et al.
6,170,154 B1 1/2001 Swarup
6,186,834 B1 2/2001 Arnett et al.
6,196,880 B1 3/2001 Goodrich et al.
6,238,235 B1 5/2001 Shavit et al.
6,270,358 B1 8/2001 Nozick
6,270,381 B1 8/2001 Adriaenssens et al.
6,312,290 B1 11/2001 Belopolsky
6,350,158 B1 2/2002 Arnett et al.
6,353,540 B1 3/2002 Akiba et al.
6,356,162 B1 3/2002 Deflandre et al.
6,364,694 B1 4/2002 Lien
6,379,157 B1 4/2002 Curry et al.
6,379,198 B1 4/2002 Arnett et al.
6,407,542 B1 6/2002 Conte
6,428,362 B1 8/2002 Phommachanh
6,443,776 B2 9/2002 Reichle
6,443,777 B1 9/2002 McCurdy et al.
6,454,541 B1 9/2002 Ijiri et al.
6,464,529 B1 10/2002 Jensen et al.
6,520,807 B2 * 2/2003 Winings ..... 439/676
6,524,128 B2 * 2/2003 Marowsky et al. ..... 439/418
6,530,810 B2 3/2003 Goodrich
6,558,204 B1 5/2003 Weatherly
6,558,207 B1 5/2003 Pepe et al.
6,561,838 B1 5/2003 Blichfeldt
6,571,187 B1 5/2003 Conte
6,592,395 B2 7/2003 Brown et al.
6,647,357 B1 11/2003 Conte
6,716,964 B1 4/2004 Chinnadurai
6,764,348 B2 7/2004 Han et al.
6,811,442 B1 11/2004 Lien et al.
6,962,503 B2 * 11/2005 Aekins ..... 439/418
2001/0018287 A1 8/2001 Reichie
2001/0021608 A1 9/2001 Borbolla et al.
2001/0048592 A1 12/2001 Nimomiya
2002/0088977 A1 7/2002 Mori et al.
2003/0129880 A1 7/2003 Arnett et al.
2004/0002267 A1 1/2004 Hatterscheid et al.
2005/0254223 A1 11/2005 Hashim
2006/0121788 A1 6/2006 Pharney
2006/0121789 A1 6/2006 Hashim
2006/0160428 A1 7/2006 Hashim

FOREIGN PATENT DOCUMENTS

EP 0 525 703 B1 2/1993
EP 0 901 201 3/1999
EP 1 059 704 12/2000
EP 1 191 646 3/2002
EP 1 435 679 7/2004
WO WO 94/05092 3/1994
WO WO 99/53574 10/1999
WO WO 2003-019734 3/2003
WO WO 03/090322 10/2003

OTHER PUBLICATIONS

Belden CDT Networking Data Sheet for the 10GX Module www.BeldenIBDN.com.
International Search Report for PCT/US2006/002936; Date of mailing May 15, 2006.

* cited by examiner

COMMUNICATION PLUG WITH BALANCED WIRING TO REDUCE DIFFERENTIAL TO COMMON MODE CROSSTALK

RELATED APPLICATIONS

The present application claims priority from U.S. Provisional Patent Application Ser. Nos. 60/633,783, filed Dec. 7, 2004, entitled Communication Plug with Balanced Wiring to Minimize Differential to Common Mode Crosstalk and from U.S. Provisional Patent Application Ser. No. 60/648,002, filed Jan. 28, 2005, entitled CONTROLLED MODE CONVERSION PLUG FOR REDUCED ALIEN CROSSTALK, the disclosures of which are hereby incorporated herein in their entireties.

FIELD OF THE INVENTION

The present invention relates generally to communication connectors and more particularly to near-end crosstalk (NEXT) compensation in communication connectors.

BACKGROUND OF THE INVENTION

In an electrical communication system, it is sometimes advantageous to transmit information signals (video, audio, data) over a pair of wires (hereinafter "wire-pair" or "differential pair") rather than a single wire, wherein the transmitted signal comprises the voltage difference between the wires without regard to the absolute voltages present. Each wire in a wire-pair is susceptible to picking up electrical noise from sources such as lightning, automobile spark plugs and radio stations to name but a few. Because this type of noise is common to both wires within a pair, the differential signal is typically not disturbed. This is a fundamental reason for having closely spaced differential pairs.

Of greater concern, however, is the electrical noise that is picked up from nearby wires or pairs of wires that may extend in the same general direction for long distances and not cancel differentially on the victim pair. This is referred to as differential crosstalk. Particularly, in a communication system where a modular plug often used with a computer is to mate with a modular jack, the electrical wires (conductors) within the jack and/or plug also can produce near-end crosstalk (NEXT) (i.e., the crosstalk measured at an input location corresponding to a source at the same location). This crosstalk occurs from closely-positioned wires over a short distance. In all of the above situations, undesirable signals are present on the electrical conductors that can interfere with the information signal. As long as the same noise signal is added to each wire in the wire-pair, the voltage difference between the wires will remain about the same and differential cross-talk does not exist.

Crosstalk can be classified as either differential crosstalk, as described above, in which the crosstalk signal appears as a difference in voltage between two conductors of a differential pair, or common mode crosstalk, in which the crosstalk signal appears common to both conductors of a differential pair. Differential crosstalk or common mode crosstalk appearing in a communication channel can result from sources that are either differential mode or common mode in nature.

U.S. Pat. No. 5,997,358 to Adriaenssens et al. (hereinafter "the '358 patent") describes a two-stage scheme for compensating differential to differential NEXT for a plug-jack combination (the entire contents of the '358 patent are hereby incorporated herein by reference, as are U.S. Pat. Nos. 5,915,989; 6,042,427; 6,050,843; and 6,270,381). Connectors described in the '358 patent can reduce the internal NEXT (original crosstalk) between the electrical wire pairs of a modular plug by adding a fabricated or artificial crosstalk, usually in the jack, at one or more stages, thereby canceling or reducing the overall crosstalk for the plug-jack combination. The fabricated crosstalk is referred to herein as a compensation crosstalk. This idea can often be implemented by crossing the path of one of the differential pairs within the connector relative to the path of another differential pair within the connector twice, thereby providing two stages of NEXT compensation for that pair-to-pair relationship. This scheme can be more efficient at reducing the NEXT than a scheme in which the compensation is added at a single stage, especially when the second and subsequent stages of compensation include a time delay that is selected to account for differences in phase between the offending and compensating crosstalk. This type of arrangement can include capacitive and/or inductive elements that introduce multi-stage crosstalk compensation, and is typically employed in jack lead frames and PWB structures within jacks. These configurations can allow connectors to meet "Category 6" performance standards set forth in ANSI/EIA/TIA 568, which are primary component standards for mated plugs and jacks for transmission frequencies up to 250 MHz.

Alien NEXT is the differential crosstalk that occurs between communication channels. Obviously, physical separation between jacks will help and/or typical crosstalk approaches may be employed. However, a problem case may be "pair 3" of one channel crosstalking to "pair 3" of another channel, even if the pair 3 plug and jack wires in each channel are remote from each other and the only coupling occurs between the routed cabling. To reduce this form of alien NEXT, shielded systems containing shielded twisted pairs or foiled twisted pair configurations may be used. However, the inclusion of shields can increase cost of the system. Another approach to reduce or minimize alien NEXT utilizes spatial separation of cables within a channel and/or spatial separation between the jacks in a channel. However, this is typically impractical because bundling of cables and patch cords is common practice due to "real estate" constraints and ease of wire management.

In spite of recent strides made in improving mated connector (i.e., plug-jack) performance, and in particular reducing crosstalk at elevated frequencies (e.g., 500 MHz—see U.S. patent application Ser. No. 10/845,104, entitled NEXT High Frequency Improvement by Using Frequency Dependent Effective Capacitance, filed May 4, 2004, the disclosure of which is hereby incorporated herein by reference), many connectors that rely on either these teachings or those of the '358 patent can still exhibit unacceptably high alien NEXT at very high frequencies (e.g., 500 MHz). As such, it would be desirable to provide connectors with reduced alien NEXT at very high frequencies.

SUMMARY OF THE INVENTION

The present invention provides communications connectors, in particular communications plugs, that may have improved crosstalk performance. As a first aspect, embodiments of the present invention are directed to a communications plug, comprising: a mounting substrate; a plurality of pairs of output terminals; and first, second, third and fourth pairs of conductors. The first, second and fourth pairs of the output terminals are arranged in immediately adjacent relationship, and a third pair of output terminals includes output terminals that are separated from each other such that a first output terminal of the third pair is positioned between the first and second pairs of output terminals, and such that a second output terminal of the third pair is positioned between the first and fourth pairs of output terminals. Each of the first, second, third and fourth pairs of conductors engages the mounting substrate and is attached for electrical communication with a respective one of the output terminals. The third pair of conductors has at least two locations in which the conductors of the pair cross each other, and is arranged such that, between the crossover locations, the third pair of conductors forms an expanded loop that brings segments of the third conductor into closer proximity to the second and fourth pairs of conductors than to the first pair of conductors. In this configuration, the plug (which in some embodiments is a communications plug) may exhibit a reduced tendency for differential to common mode crosstalk conversion, particularly between the third pair of conductors and the second and fourth pairs of conductors, which can improve alien NEXT performance between channels, particularly at elevated frequencies.

As a second aspect, embodiments of the present invention are directed to a communications plug, comprising: a mounting substrate; a plurality of pairs of output terminals; and first, second, third and fourth pairs of conductors. The first, second and fourth pairs of the output terminals are arranged in immediately adjacent relationship, and a third pair of output terminals includes output terminals that are separated from each other such that a first output terminal of the third pair is positioned between the first and second pairs of output terminals, and such that a second output terminal of the third pair is positioned between the first and fourth pairs of output terminals. Each of the first, second, third and fourth pairs of conductors engages the mounting substrate and is attached for electrical communication with a respective one of the output terminals. The third pair of conductors has at least two locations in which the conductors of the pair cross each other. The third pair of conductors is arranged such that, between the crossover locations, the third pair of conductors forms an expanded loop that brings segments of the third conductor into relative proximity to the first, second and fourth pairs of conductors. The positioning of the second, third and fourth pairs of conductors substantially prevents the conversion of differential mode crosstalk to common mode crosstalk between (a) the second and third pairs of conductors and (b) the third and fourth pairs of conductors. This configuration can reduce the alien NEXT experienced between a plug-jack combination, especially at elevated frequencies.

As a third aspect, the present invention is directed to a mounting substrate for a communications plug. The mounting substrate includes: a body formed of a dielectric material; a spreading member mounted to an upper surface of the body, the spreading member being configured to receive respective conductors on opposite sides thereof, and capture members mounted to opposing edge portions of the upper surface of the body. Each of the capture members is configured to receive a pair of conductors and maintain the pairs of conductors at a given distance from conductors received in the spreading member channels. This configuration can position the respective conductors such that alien NEXT performance is improved.

DETAILED DESCRIPTION OF EMBODIMENTS OF THE INVENTION

Figure 1:
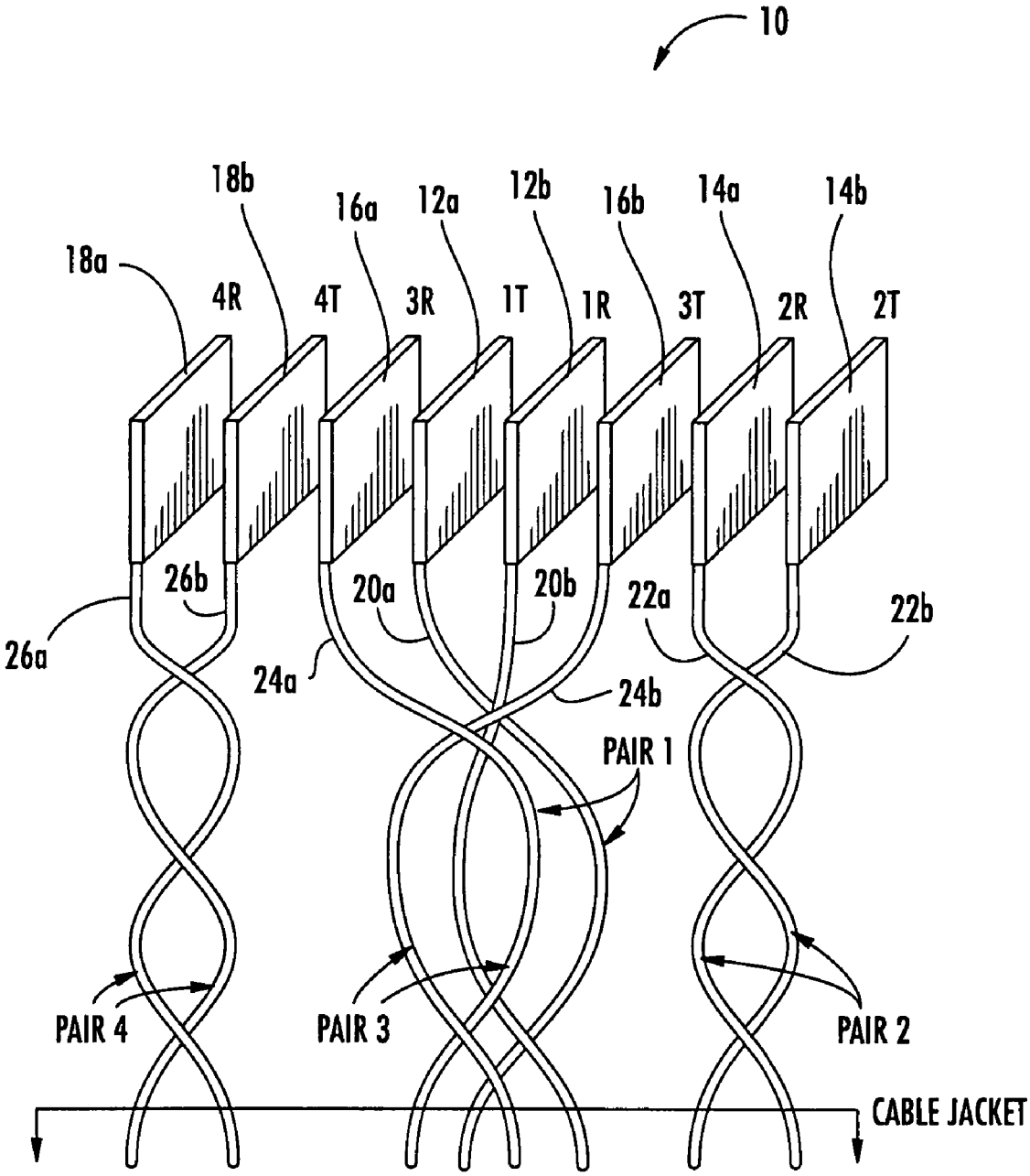
FIG. 1 (PRIOR ART)
FIG. 1 is a stylized partial perspective view of the blades and conductors of a prior art plug.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms “a”, “an” and “the” are intended to include the plural forms as well, unless the context clearly indicates otherwise. As used herein, the term “and/or” includes any and all combinations of one or more of the associated listed items.

This invention is directed to communications connectors, with a primary example of such being a communications plug. As used herein, the terms "forward", "forwardly", and "front" and derivatives thereof refer to the direction defined by a vector extending from the center of the plug toward the free end of the plug, ie., away from a cable attached to the plug. Conversely, the terms "rearward", "rearwardly", and derivatives thereof refer to the direction directly opposite the forward direction; the rearward direction is defined by a vector that extends from the center of the plug toward the cable. The terms "lateral," "laterally", and derivatives thereof refer to the direction generally parallel with the plane defined by the conductors as they align at the forward end of the plug and extending away from a plane bisecting the plug in the center. The terms "medial," "inward," "inboard," and derivatives thereof refer to the direction that is the converse of the lateral direction, i.e., the direction parallel with the plane defined by the conductors and extending from the periphery of the plug toward the aforementioned bisecting plane. Where used, the terms "attached", "connected", "interconnected", "contacting", "coupled", "mounted" and the like can mean either direct or indirect attachment or contact between elements, unless stated otherwise.

Turning now to the figures, FIG. 1 illustrates a typical wiring layout for a prior art communication plug 10 having four pairs of twisted wires 20*a*, 20*b*, 22*a*, 22*b*, 24*a*, 24*b*, 26*a*, 26*b*. As is conventional pursuant to TIA 568B plug wiring standards, wire pair 1 (wires 20*a*, 20*b*) is in the center of the plug 10 (connected to blades 12*a*, 12*b*), wire pair 2 (wires 22*a*, 22*b*) occupies the right side of the plug 10 (connected to blades 14*a*, 14*b*), wire pair 4 (wires 26*a*, 26*b*) occupies the left side of the plug 10 (connected to blades 18*a*, 18*b*), and wire pair 3 (wires 24*a*, 24*b*) straddles wire pair 1 (connected to blades 16*a*, 16*b*). As is conventional, each of these pairs of wires is twisted, with the lay lengths of the twists of these pairs being slightly different. Because wire pair 3 straddles wire pair 1, the tip of pair 3 (i.e., blade 16*b* and wire 24*b*) is closer to both conductors 22*a*, 22*b* and blades 14*a*, 14*b* of pair 2 (especially in the blade region) than is the ring of pair 3 (ie., blade 16*a* and wire 24*a*). Similarly, blade 16*a* and wire 24*a* are closer to both conductors 26*a*, 26*b* and blades 18*a*, 18*b* of pair 4 than are blade 16*b* and wire 24*b*, especially in the blade region. Consequently, the blades 16*a*, 16*b* and wires 24*a*, 24*b* of pair 3 are spatially unbalanced relative to the end pairs 2 and 4, particularly in the plug blades and the region approaching the blades.

This imbalance typically effectively occurs from the point of contact with a connecting jack through the plug blades and the connecting wires back into the plug 10. The magnitude of the imbalance depends on the distance into the plug 10 that the wires 24*a*, 24*b* of pair 3 remain separated before returning to the twisted configuration that is characteristic of a twisted pair. The imbalance between (a) pair 3 and pair 2 and (b) pair 3 and pair 4 can convert a differential mode signal on pair 3 to common mode crosstalk on pairs 2 and 4 in the plug 10. Although this conversion from differential to common mode crosstalk can occur across the frequency band below 250 MHz, the resulting channel alien NEXT generated is typically minimal. However, it has been discovered in connection with the present invention that at elevated transmission frequencies (e.g., up to 500 MHz), the conversion of differential to common mode crosstalk can have a substantial detrimental impact on channel alien NEXT levels and, likely, the ability of the channel to meet FCC emission level limits, particularly at elevated transmission frequencies.

The imbalance typically experienced in conventional plugs 10 can be addressed by plugs of the present invention, embodiments of which are illustrated in FIGS. 2–9. These plugs can substantially reduce the amount of differential to common mode crosstalk conversion that occurs compared with prior art connectors. Generally speaking, it has been discovered that by reducing the differential to common mode crosstalk conversion in a plug, better alien NEXT performance can be achieved, particularly at elevated frequencies (i.e., above 250 MHz).

Figure 2:
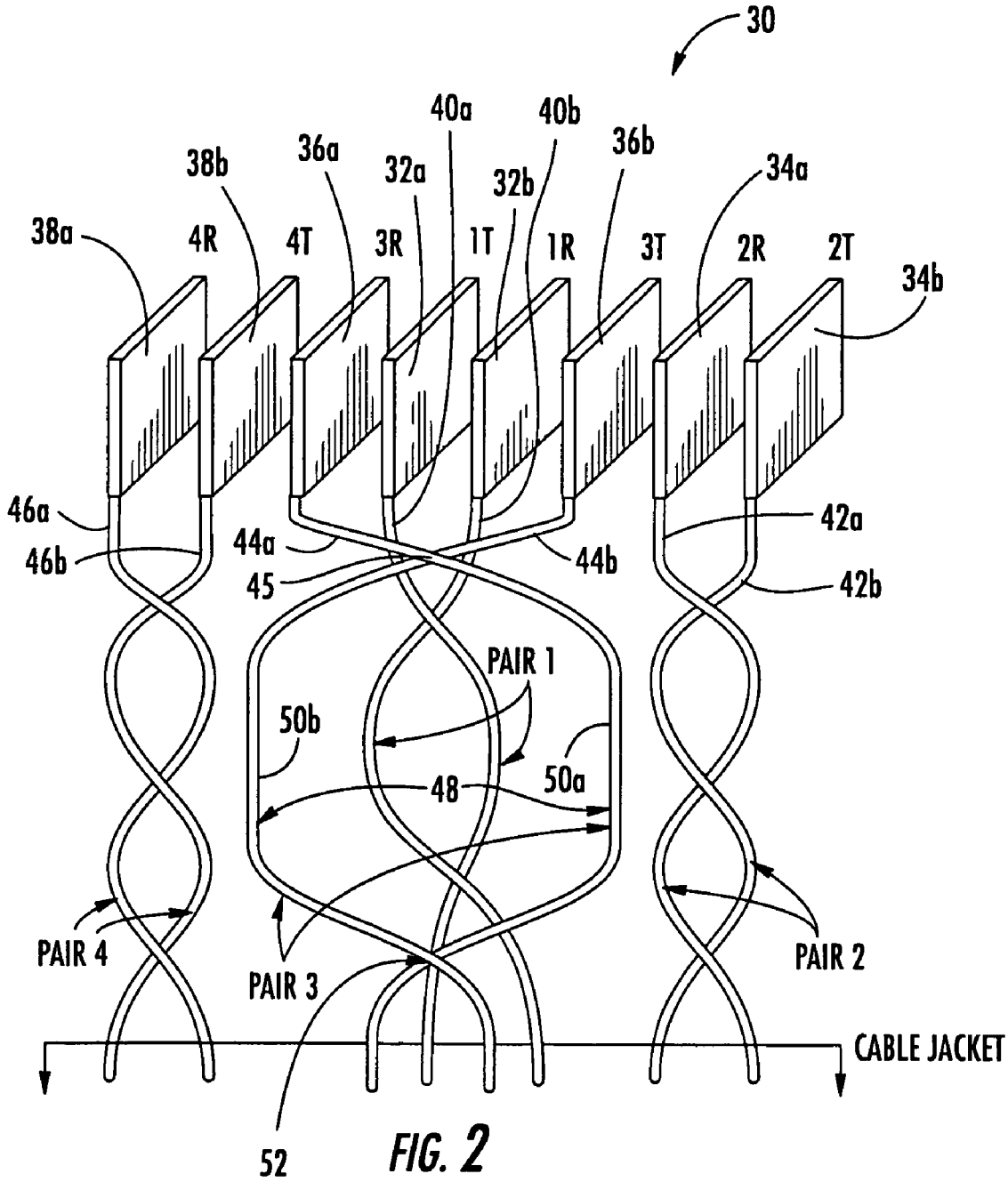
FIG. 2 is a stylized partial perspective view of blades and conductors of embodiments of plugs of the present invention.

Referring now to FIG. 2, a stylized embodiment of a plug of the present invention, designated broadly at 30, is illustrated therein. The plug 30 includes eight blades 32*a*, 32*b*, 34*a*, 34*b*, 36*a*, 36*b*, 38*a*, 38*b* and eight conductors 40*a*, 40*b*, 42*a*, 42*b*, 44*a*, 44*b*, 46*a*, 46*b* twisted into pairs and attached to the blades in the same pairings as set forth above for the plug 10 of FIG. 1. Notably, the conductors of pair 3 (ie., conductors 44*a*, 44*b*) are arranged such that, after a first crossover point 45 adjacent the blade region, the conductors 44*a*, 44*b* form an expanded loop 48 that terminates at a second crossover point 52 (where typical twisting of conductors of pair 3 occurs). The expanded loop 48 includes segments 50*a*, 50*b* that are positioned adjacent to conductor pair 2 (conductors 42*a*, 42*b*) and conductor pair 4 (conductors 46*a*, 46*b*), respectively, and that are spaced apart from conductor pair 1 (conductors 40*a*, 40*b*). In this configuration, the spatial imbalance between (a) pairs 2 and 3 and (b) pairs 3 and 4 caused by the positions of the blades and wire attachments thereto can be overcome. As a result, the conversion of differential crosstalk to common mode crosstalk ordinarily occurring in the plug 10 of FIG. 1 can be prevented or substantially reduced, with the result that alien NEXT performance of the plug 30 can be improved.

This configuration may be suitable for use in a variety of communication connectors, including plugs, patch panels, and the like. The configuration may be particularly suitable for use in a communications plug, such as that illustrated in FIGS. 3, 3A, 4 and 6 and designated broadly at 60. The plug 60 includes a mounting sled 64 that mounts terminating blades (not shown in FIGS. 3, 4 and 6) and maintains conductors 40*a*–46*b* in their desired arrangement prior to their merging into a cable 61. The mounting sled 64, which is typically formed of a polymeric material such as acrylonitrile-butadiene-styrene copolymer (ABS), includes a relatively flat body 66. A spreading member 68 extends upwardly from a central portion of the body 66. The spreading member 68 defines two channels 70 on lateral sides thereof; each of the channels 70 is configured to receive one of the conductors 44*a*, 44*b* of pair 3. The sled 64 also includes a pair of wings 72 on opposed lateral portions thereof. Each of the wings 72 extends upwardly and outwardly from the body 66 and defines a channel 76 that receives a twisted pair of conductors, i.e., either conductors 42*a*, 42*b* (pair 2) or conductors 46*a*, 46*b* (pair 4). A slot 74 is present in the body 66 below the spreading member 68 (see FIGS. 3A and 4). The slot 74 is sized to receive the conductors 40*a*, 40*b* of pair 1. An alignment projection 78 is located on each rear side edge of the body 66. Also, an X-shaped guide 73 (see FIG. 3A) extends rearwardly from the spreading member 68. The guide 73 includes an upper vane 73*a*, a lower vane 73*b*, and lateral vanes 73*c*, 73*d*; these vanes receive pairs of conductors as they exit the cable 61 and guide them to their respective locations on the sled 64.

Figure 3:
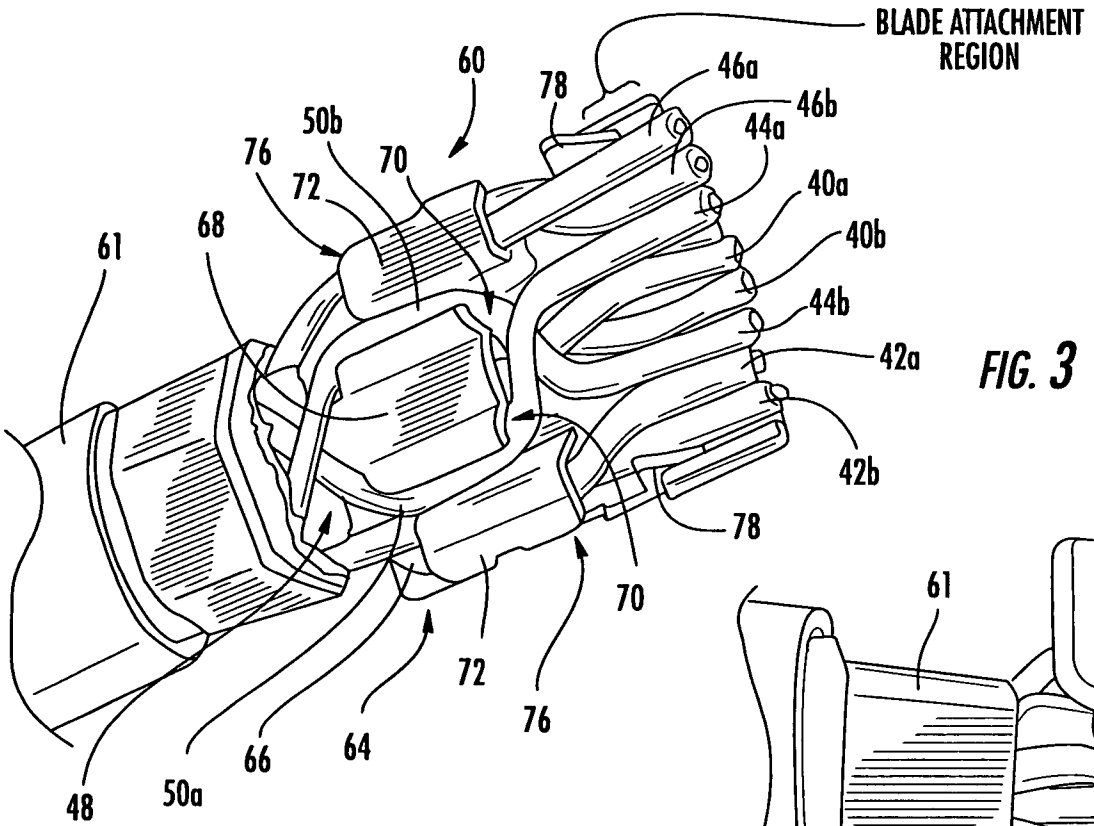
FIG. 3 is a top perspective view of an embodiment of a communications plug according to the present invention with its housing removed.
Figure 4:
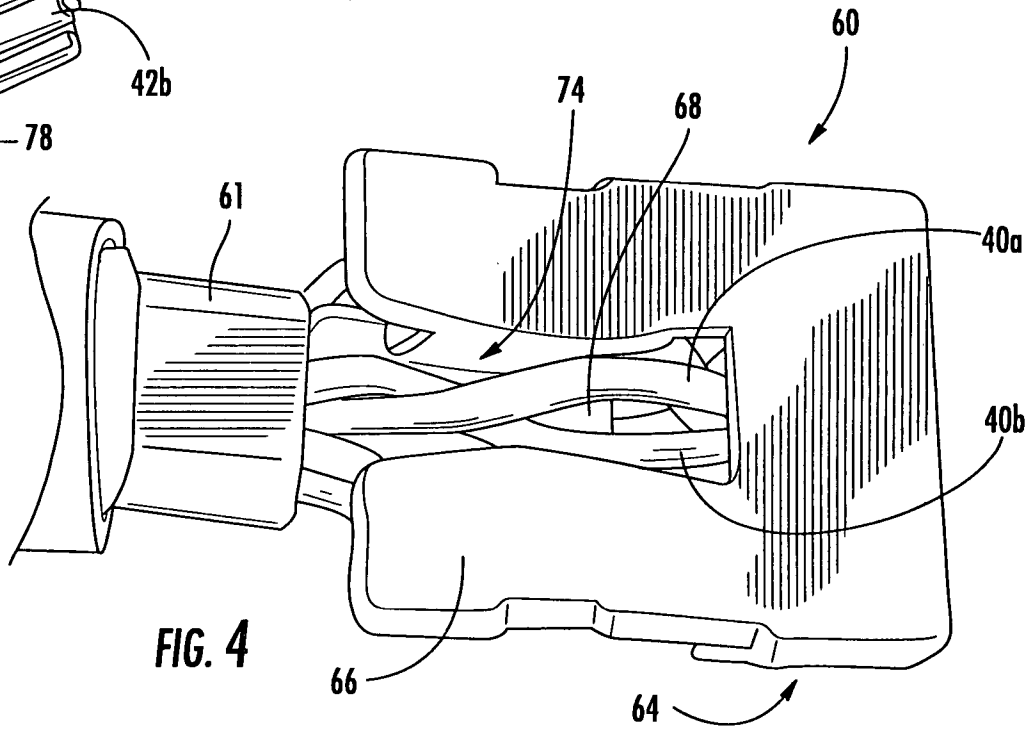
FIG. 4 is a bottom perspective view of the plug of FIG. 3.
Figure 3A:
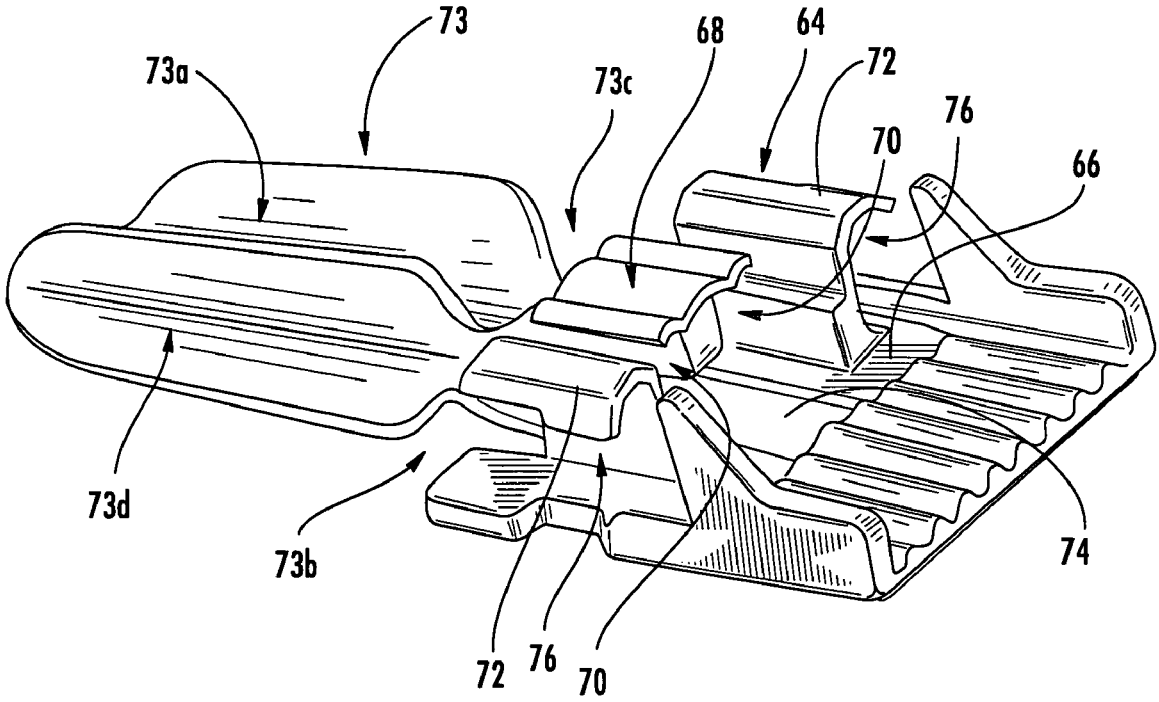
FIG. 3A is a top perspective view of the mounting sled of the plug of FIG. 3.

It can be seen in FIGS. 3 and 4 that each of the twisted pairs of conductors is maintained in position as it travels over/through the sled 64. In this configuration, conductors 44*a*, 44*b* form an expanded loop 48 of the variety described above. The segment 50*a* is positioned adjacent the conductors 42*a*, 44*a*, and the segment 50*b* is positioned adjacent the conductors 46*a*, 46*b*. In this embodiment, the length of the segments 50*a*, 50*b* is typically between about 0.150 and0.250 inch, and they are typically positioned within about 0.030 and 0.040 inch of their respective laterally adjacent wire pairs. The width of the expansion loop 48 (ie., the distance between the segments 50*a*, 50*b*) is typically between about 0.150 and 0.200 inch, which can position the segments 50*a*, 50*b* about 0.050 to 0.080 inch from the conductors 40*a*, 40*b* of pair 1. These dimensions may be typical for a plug having a length of about 1.0 inch. It will be understood that, although the segments 50*a*, 50*b* are shown as being substantially parallel to closely proximate portions of the conductors of pairs 2 and 4, segments that are only generally parallel to each other, that are disposed at an oblique angle, or that are skewed relative to each other may also be suitable for use with the present invention. In additional, the loop can be generally square, rectangular, oblong, hexagonal, or any other shape that brings the appropriate portions of the conductors of pair 3 into sufficiently close proximity to the conductors of pairs 2 and 4.

Figure 6:
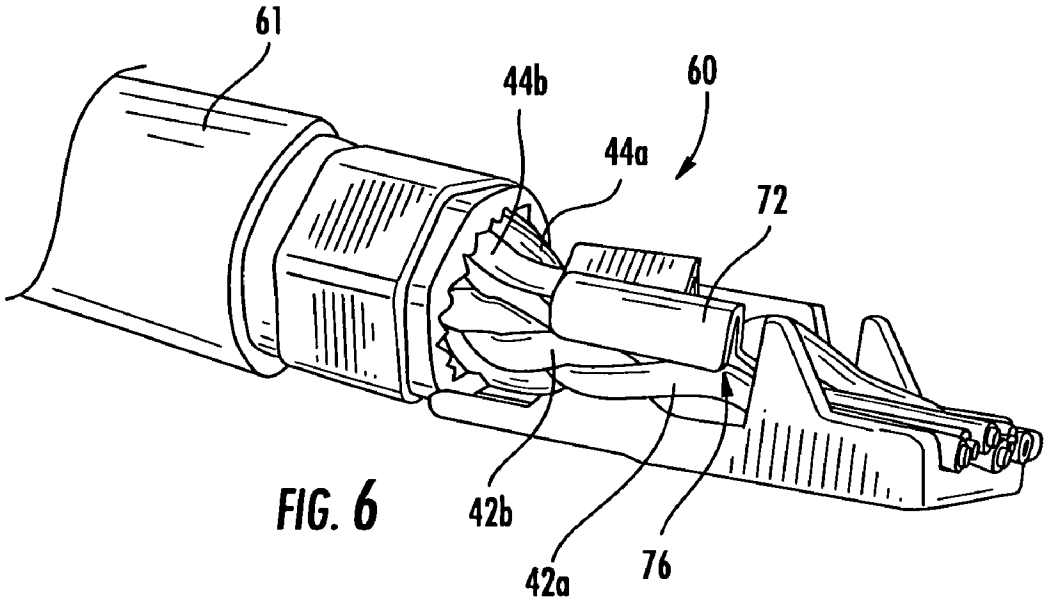
FIG. 6 is a side view of the plug of FIG. 3.
Figure 7:
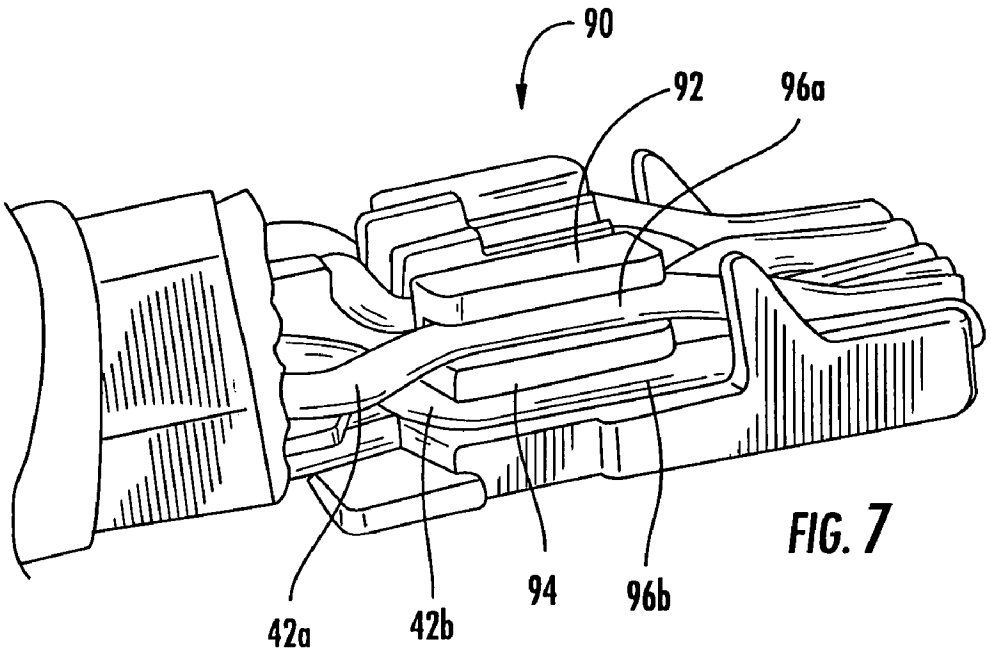
FIG. 7 is a top perspective view of another embodiment of a communications plug according to the present invention with its housing removed.

As can be seen in FIG. 6, the channels 76 of the wings 72 are sized to receive a twisted wire pair (in this instance, the conductors 42*a*, 42*b*) and to permit them to retain a twisted configuration. However, in other embodiments of plugs, the wings may take different configurations. For example, FIG. 7 illustrates a plug 90 that includes a wing member 92 that has a tine 94 that extends longitudinally and subdivides the space captured by the wing member 92 into upper and lower channels 96*a*, 96*b*, each of which is sized and configured to receive one conductor 42*a*, 42*b*. As such, in this configuration the conductors 42*a*, 42*b* do not twist around each other within the wing member 92. This sled configuration may be desirable to use to fine-tune the differential to differential pair 3 to side pair NEXT of the plug, by shifting the vertical positions of wires 50 relative to channels 96*a*, 96*b*.

As noted above, the sled 64 of the plug 60 is fashioned such that the conductors 40*a*, 40*b* of pair 1 pass through the slot 74 that is positioned beneath the spreading member 68. This configuration may facilitate placement of the conductors in the sled 64 when the conductors 44*a*, 44*b* of pair 3 are positioned in the top quadrant of the cable 61 from which they emerge, and the conductors 40*a*, 40*b* of pair 1 are positioned in the bottom quadrant of the cable 61 (see FIGS. 3 and 4), but threading of the conductors 40*a*, 40*b* through a slot when the conductors 40*a*, 40*b* are positioned at the top quadrant of the cable 61 (as will occur at one end of the cable 61 or the other in order that the conductors remain in the same order as they attach to blades) may be difficult. To address this "unfriendly" wiring condition, a plug such as that designated broadly at 80 in FIG. 5 may be employed. The plug 80 includes a spreading member 82 with a trough 83 having a longitudinally-oriented central channel 84. The channel 84 receives the twisted conductors 40*a*, 40*b* of pair 1 as they exit the top quadrant of the cable 61. The conductors 44*a*, 44*b* of pair 3 exiting the cable 61 from the bottom quadrant are routed upwardly to the top side of the sled and to lateral channels 87 of the spreading member 82 in order to form an expanded loop. Once the conductors 44*a*, 44*b* of pair 3 travel past the spreading member 82, they cross over one another above the conductors 40*a*, 40*b* of pair 1 just before the blade attachment region as shown.

Figure 8:
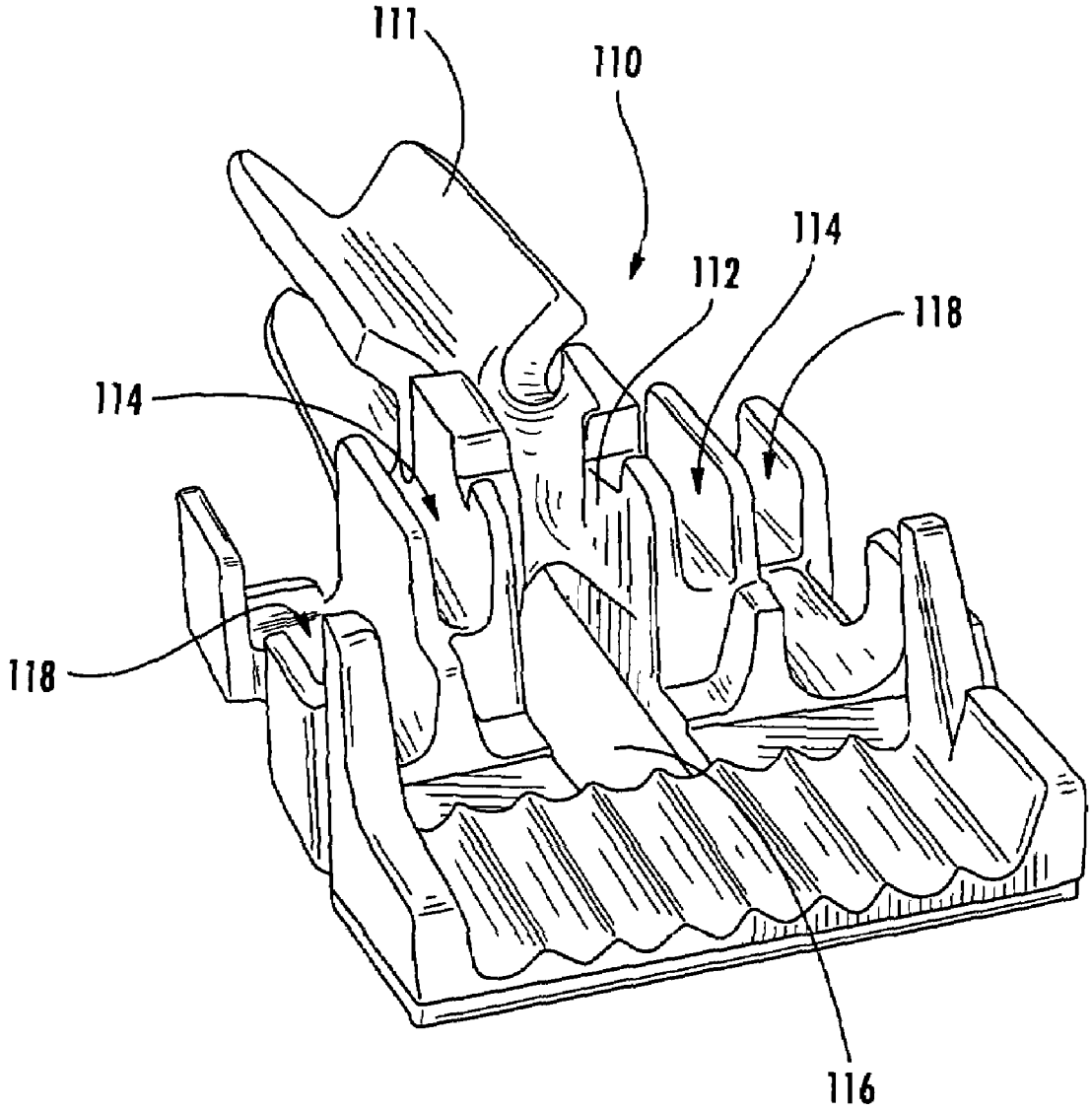
FIG. 8 is a perspective view of another embodiment of a mounting sled for a communication plug according to the present invention.

Another embodiment of a mounting sled according to the present invention is illustrated in FIG. 8 and designated broadly therein at 110. The sled 110 includes a guide 111 that receives the conductors from the cable as illustrated above (such a guide is described in U.S. Pat. No. 6,250,949 to Lin, the disclosure of which is hereby incorporated herein in its entirety). However, in this embodiment, the spreading member 112 defines two open channels 114 that receive the conductors of pair 3 as they form an expanded loop. The spreading member 112 overlies a slot 116 that receives the conductors of pair 1. Rather than utilizing lateral wings as illustrated in FIGS. 3–7 above as the capture members for the conductors of pairs 2 and 4, the sled 110 has lateral open troughs 118 that capture the conductors of pairs 2 and 4.

Those skilled in this art will recognize that other configurations of capture members for the laterally positioned pairs, including troughs, channels, tunnels, vanes, and the like, that maintain the laterally positioned pairs in their desired locations may also be employed with the present invention. Further, those skilled in this art will recognize that other configurations of spreading members, including channels, troughs, vanes, tunnels and the like, that maintain the expanded loop configuration of pair 3 may also be employed.

Figure 10:
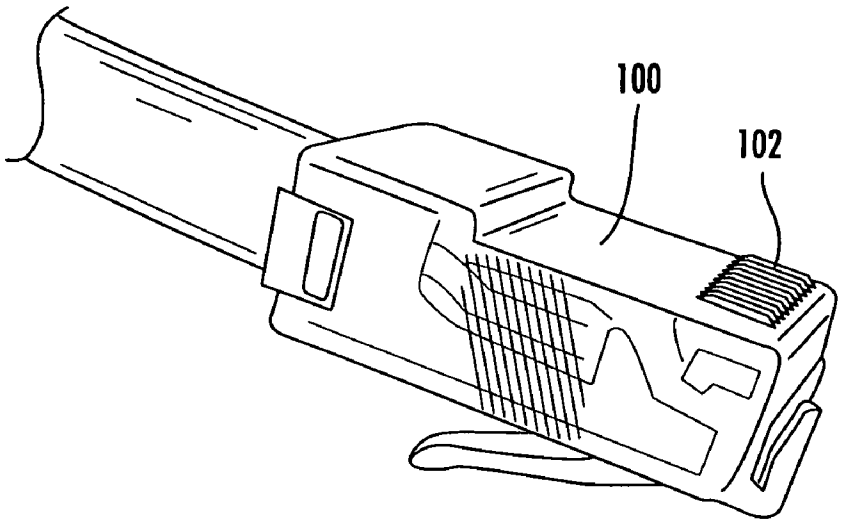
FIG. 10 is a top perspective view of the plug of FIG. 3 with the housing in place.
Figure 9:
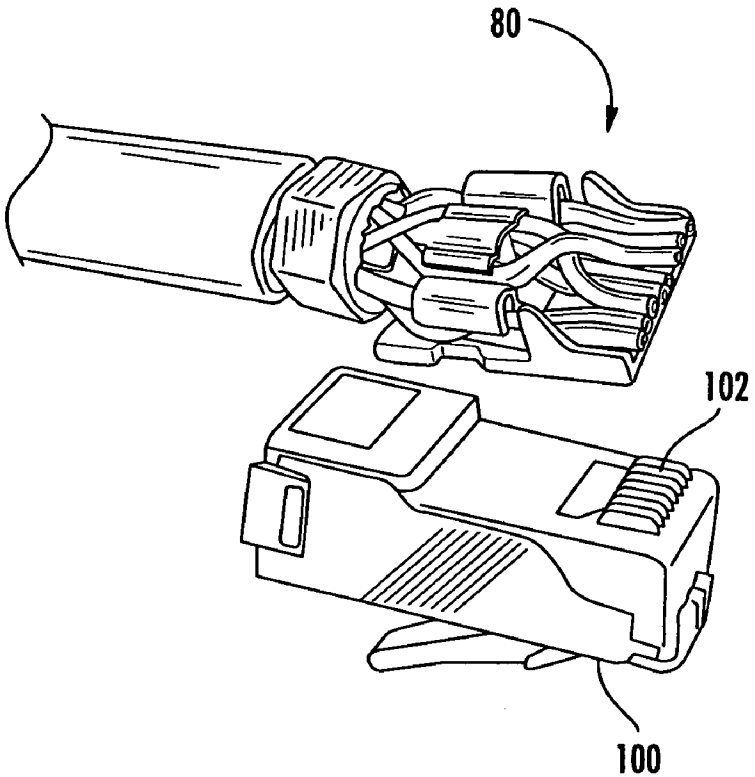
FIG. 9 is an exploded perspective view of the plug of FIG. 3 showing the housing.

Any of the plugs and sleds illustrated and described above may be housed within a housing 100 (see FIGS. 9 and 10). The housing 100 has blades 102 mounted therein that electrically connect with the conductors 40*a*–46*b*. Once the housing 100 is attached, the plug can be inserted into a jack for use. Typically, the housing 100 will be shaped to enable the plug to function as an RJ11 or RJ45-style plug for insertion into a complementary jack.

Those skilled in this art will recognize that the "expanded loop" configuration of the conductors of pair 3 may be applicable to other types of plugs. For example, an expanded loop configuration may be suitable for rigid wire lead frame type plugs (see U.S. Pat. No. 5,989,071 to Larsen et al. and U.S. Pat. No. 5,951,330 to Reichard et al, the disclosures of each of which are hereby incorporated herein in their entireties). Also, the ordinarily skilled artisan should also appreciate that this configuration is not limited to use with plugs with eight conductors; it may also, for example, be suitable for use with sixteen conductors.

As noted, plug-jack combinations employing plugs of the present invention may be especially suitable for use with elevated frequencies transmission, and may have acceptable channel alien NEXT performance at somewhat higher frequencies. For example, plug-jack combinations may result in channel alien NEXT of less than —60 dB power sum at 100 MHz, and less than —49.5 dB power sum at 500 MHz.

The invention is described further below in the following non-limiting example.

EXAMPLE

Figure 5:
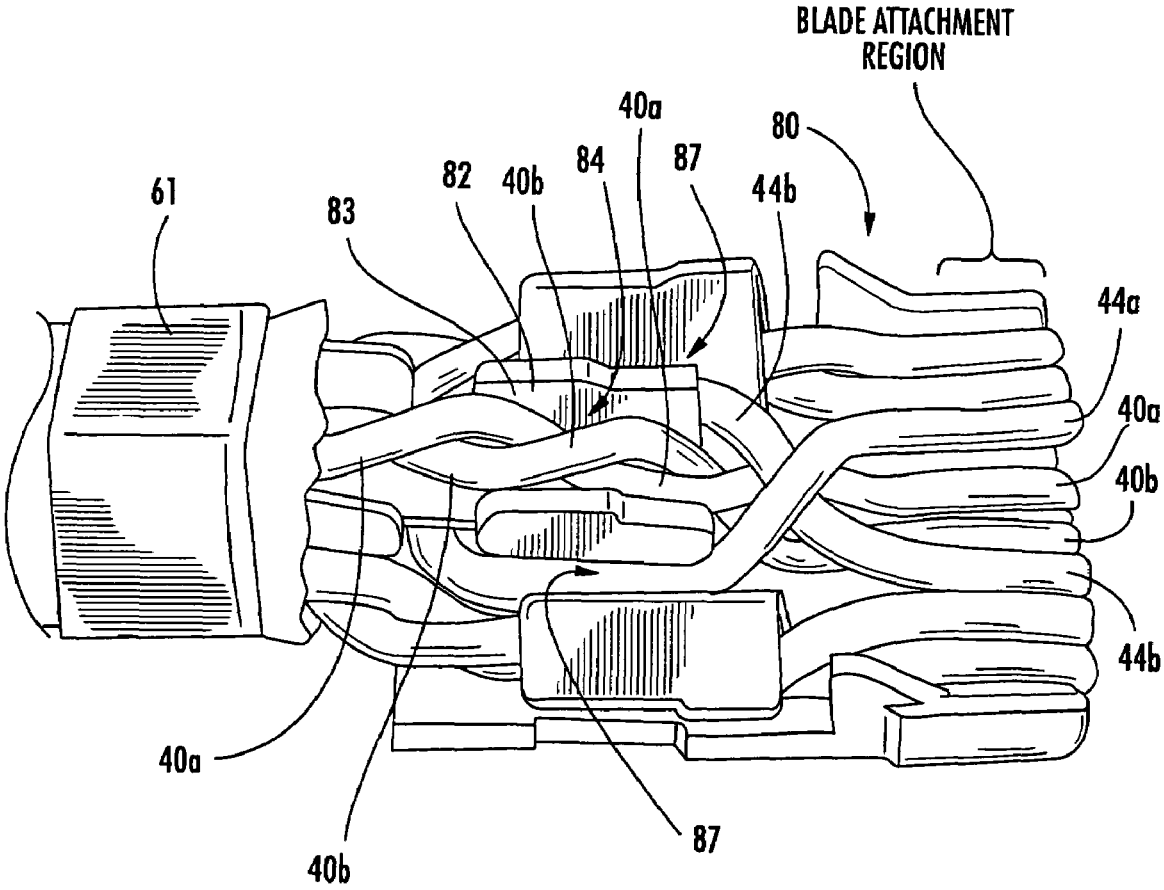
FIG. 5 is a top perspective view of another embodiment of a communications plug according to the present invention with its housing removed.

Plugs having the configuration illustrated in FIGS. 3 and 5 above were constructed of conventional materials. The conductors of pair 3 were formed into an expanded loop having a width of 0.2 inch and segments having a length of about 0.22 inch. This spacing positioned the segments of pair 3 about 0.050 inch from the conductors of pair 1 and about 0.030 inch from the conductors of pairs 2 and 4. Differential to common mode scattering testing was then conducted on this plug and a conventional plug (Model No. GS8E, available from Systimax Solutions, Inc., Richardson, Tex.). The three plugs were each connected to the same category 6 jack, and modal decomposition tests were performed for differential to common mode conversion between (a) pair 3 and pair 2 and (b) pair 3 and pair 4 using a system and procedures described in U.S. Pat. Nos. 6,407,542; 6,571,187; and 6,647,357 to Conte.

Figure 11:
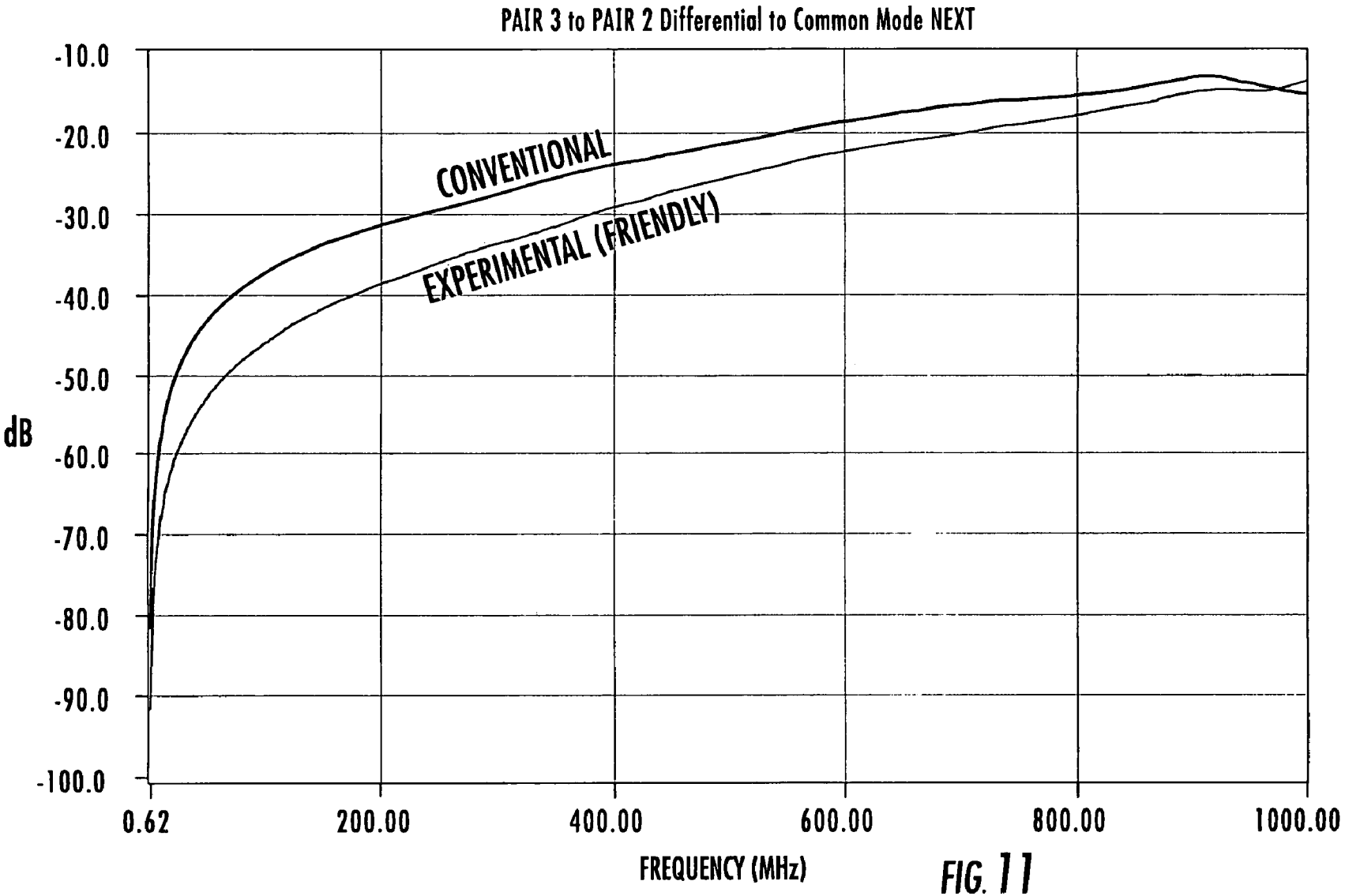
FIG. 11 is a graph plotting differential to common mode NEXT as a function of frequency for conventional and experimental communication plugs according to the embodiment of FIG. 3, wherein the NEXT of interest is between conductor pairs 3 and 2.
Figure 12:
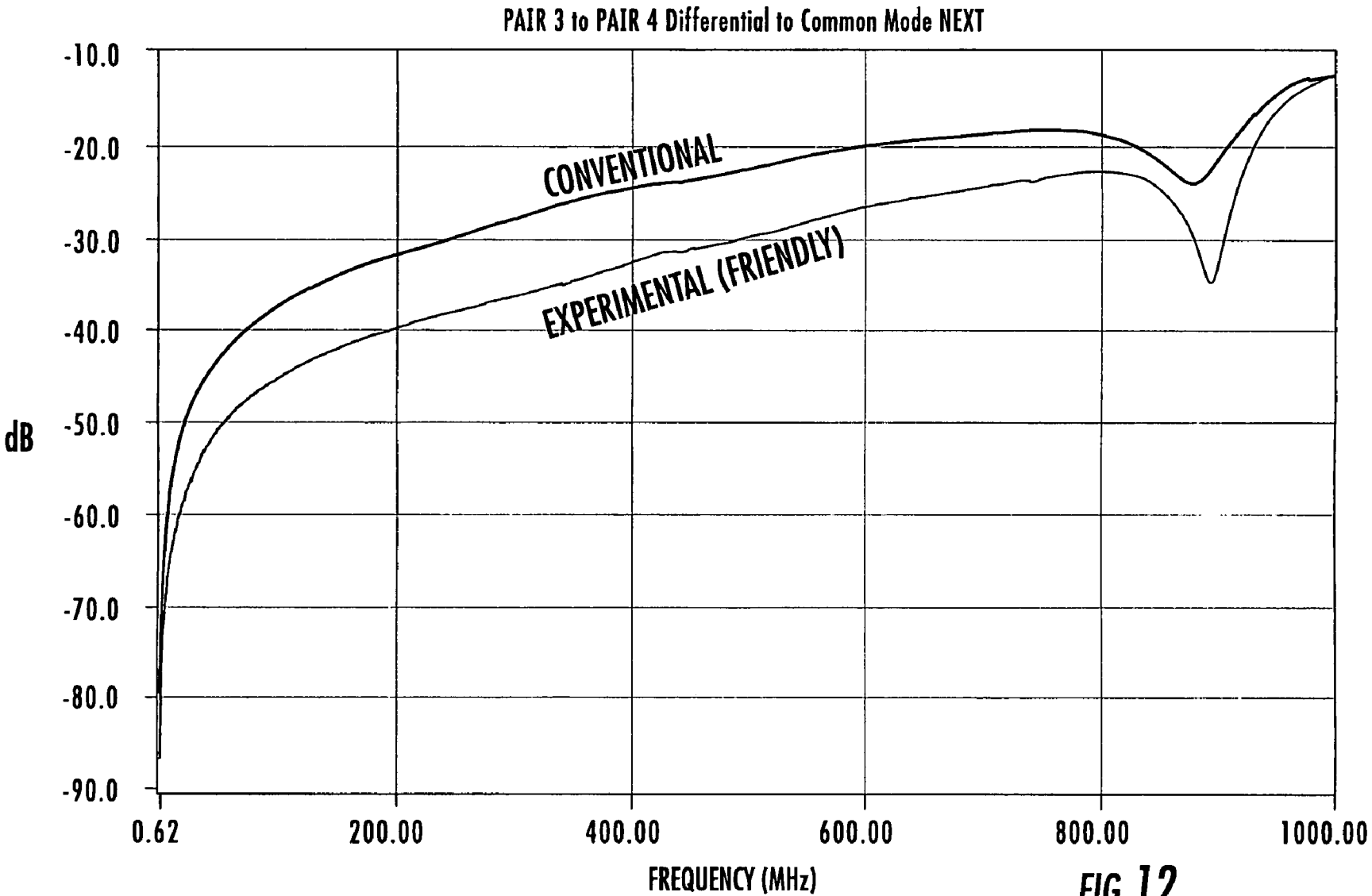
FIG. 12 is a graph plotting differential to common mode NEXT as a function of frequency for conventional and experimental communication plugs according to the embodiment of FIG. 3, wherein the NEXT of interest is between conductor pairs 3 and 4.
Figure 13:
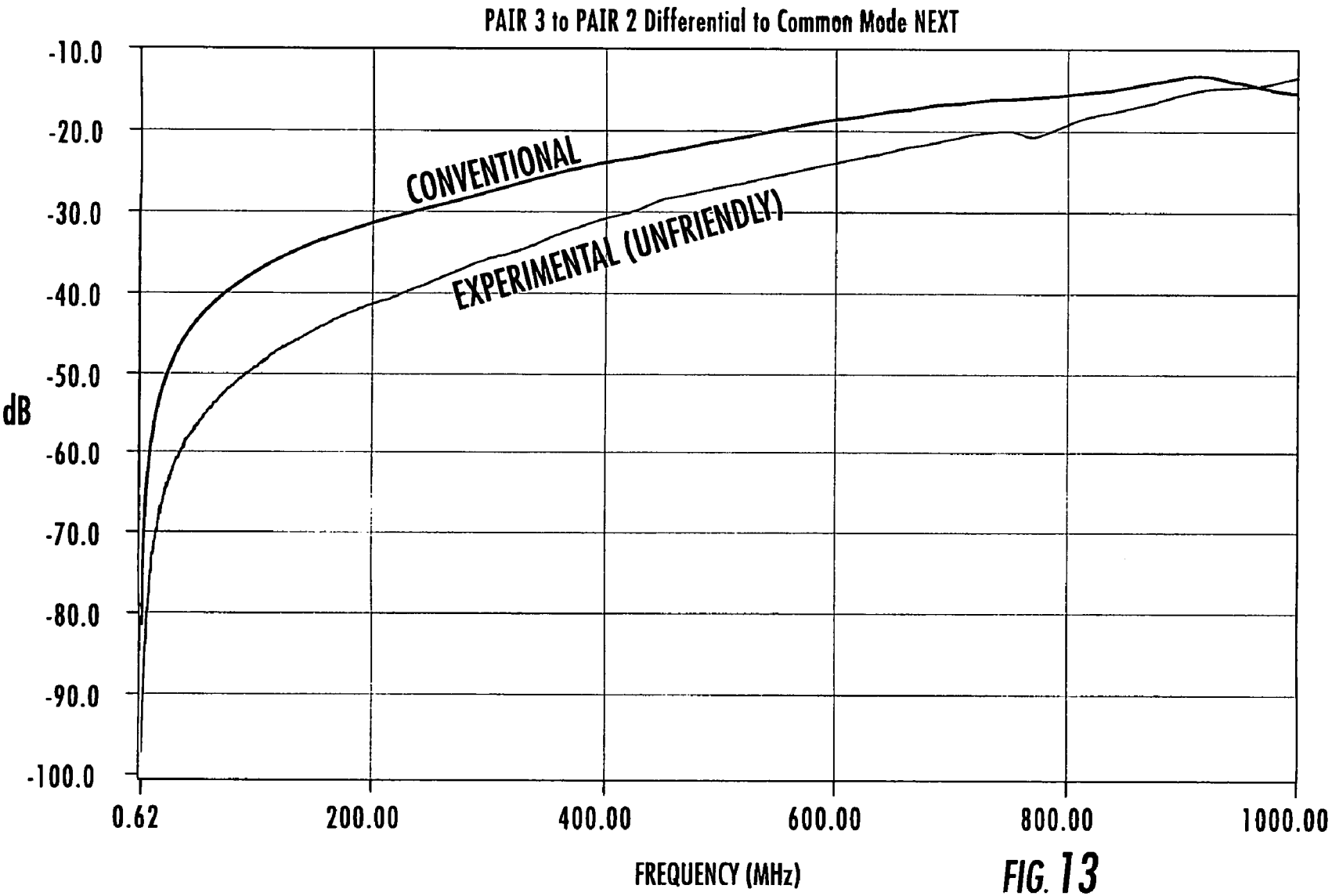
FIG. 13 is a graph plotting differential to common mode NEXT as a function of frequency for conventional and experimental communication plugs according to the embodiment of FIG. 5, wherein the NEXT of interest is between conductor pairs 3 and 2.
Figure 14:
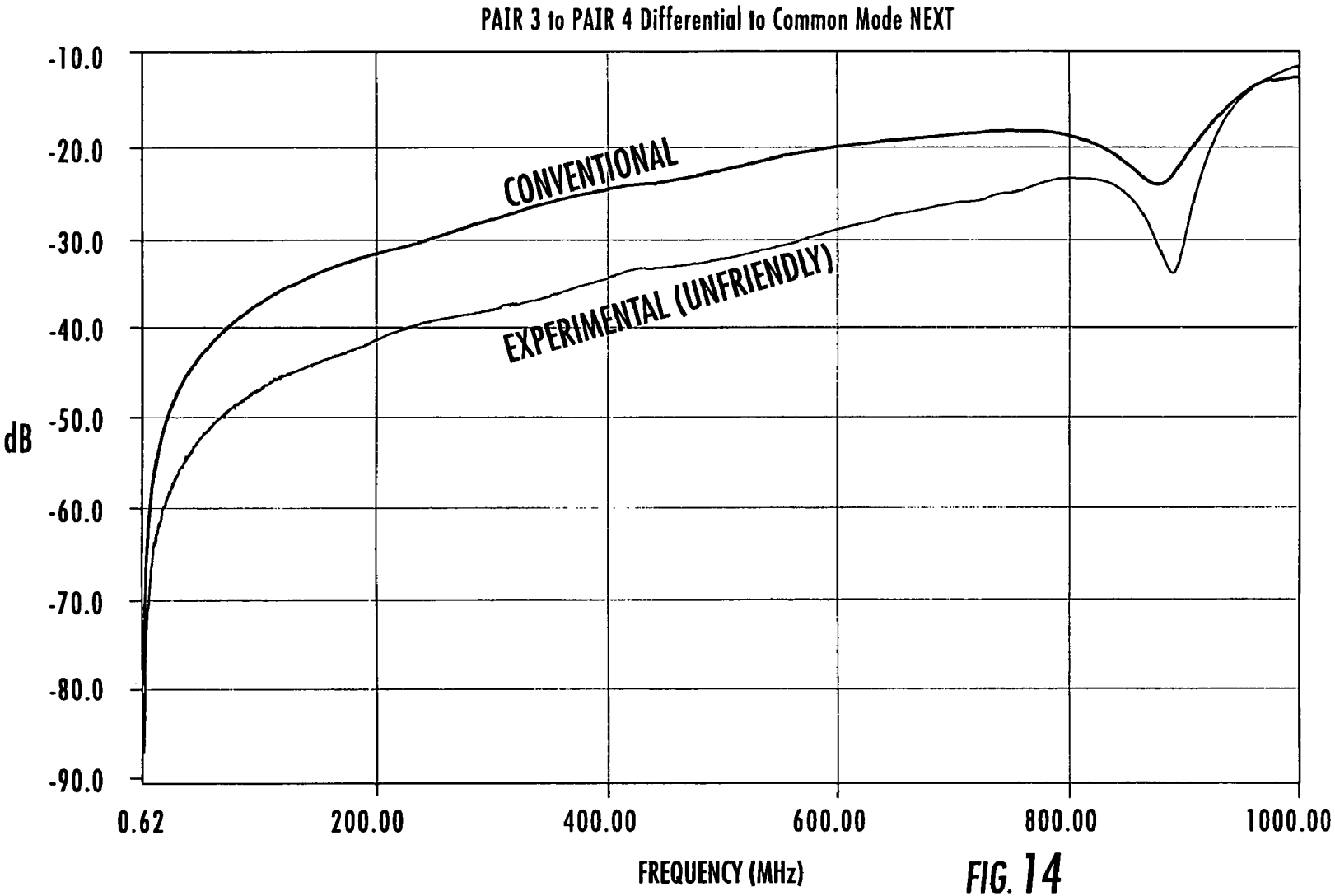
FIG. 14 is a graph plotting differential to common mode NEXT as a function of frequency for conventional and experimental communication plugs according to the embodiment of FIG. 5, wherein the NEXT of interest is between conductor pairs 3 and 4.

The results of the testing are shown in FIGS. 11–14. FIGS. 11 and 12 show the differential to common mode NEXT between pairs 3 and 2 and pairs 3 and 4, respectively, for the plug configuration of the embodiment shown in FIG. 3. FIGS. 13 and 14 show the differential to common mode NEXT between pairs 3 and 2 and pairs 3 and 4, respectively, for the plug configuration shown in FIG. 5. In each instance, the experimental plug exhibited significantly lower conversion of differential to common mode signal NEXT at virtually all frequencies. The improvement was no less than 5 dB up to 500 MHz.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A communications plug, comprising:

a mounting substrate;

a plurality of pairs of output terminals, wherein first, second and fourth pairs of the output terminals are arranged in immediately adjacent relationship, and wherein a third pair of output terminals includes output terminals that are separated from each other such that a first output terminal of the third pair is positioned between the first and second pairs of output terminals, and such that a second output terminal of the third pair is positioned between the first and fourth pairs of output terminals;

first, second, third and fourth pairs of conductors that engage the mounting substrate, each of which is attached for electrical communication with a respective one of the output terminals;

wherein the third pair of conductors has at least two locations in which the conductors of the pair cross each other, and wherein the third pair of conductors is arranged such that, between the crossover locations, the third pair of conductors forms an expanded loop that brings segments of the third conductor into closer proximity to the second and fourth pairs of conductors than to the first pair of conductors.

2. The plug defined in claim 1, wherein the pairs of output terminals comprise a series of generally parallel blades.

3. The plug defined in claim 1, wherein the mounting substrate is configured to maintain the positions of the second, third and fourth pairs of conductors.

4. The plug defined in claim 3, wherein the mounting substrate includes capture members tat capture the second and fourth pairs of conductors and a spreading member that maintains the expanded loop of the third pair of conductors.

5. The plug defined in claim 4, wherein each of the capture members includes a dividing tine that creates two separate channels, each channel receiving one of the conductors of the second and fourth pairs of conductors.

6. The plug defined in claim 4, wherein the capture members are selected from the group consisting of lateral wings and lateral troughs.

7. The plug defined in claim 4, wherein the mounting substrate further includes a slot below the spreading member that receives the first pair of conductors.

8. The plug defined in claim 4, wherein the spreading member includes a channel that receives the first pair of conductors between segments of the expanded loop of the third pair of conductors.

9. The plug defined in claim 1, wherein the first, second, third and fourth pairs of conductors are twisted wire pairs.

10. The plug defined in claim 1, wherein the width of the expanded loop of the third pair of conductors is between about 0.15 and 0.20 inches.

11. The plug defined in claim 10, wherein the length of the segments of the expanded loop of the third pair of conductors is between about 0.15 and 0.25 inches.

12. The plug defined in claim 1, wherein the segments of the expanded loop of the third pair of conductors are positioned within about 0.030 and 0.040 inches of the second and fourth pairs of conductors.

13. The plug defined in claim 12, wherein the segments of the expanded loop of the third pair of conductors are positioned about 0.050 and 0.080 inches from the first pair of conductors.

14. The plug defined in claim 1, wherein the conductors are rigid lead frame structures.

15. A communications plug, comprising:

a mounting substrate;

a plurality of pairs of output terminals, wherein first, second and fourth pairs of the output terminals are arranged in immediately adjacent relationship, and wherein a third pair of output terminals includes output terminals that are separated from each other such that a first output terminal of the third pair is positioned between the first and second pairs of output terminals, and such that a second output terminal of the third pair is positioned between the first and fourth pairs of output terminals;

first, second, third and fourth pairs of conductors that engage the mounting substrate, each of which is attached for electrical communication with a respective one of the output terminals;

wherein the third pair of conductors has at least two locations in which the conductors of the pair cross each other, and wherein the third pair of conductors is arranged such that, between the crossover locations, the third pair of conductors forms an expanded loop that brings first and second segments of the third pair of conductors into relative proximity to the second and fourth pairs of conductors, respectively, the positioning of the second, third and fourth pairs of conductors substantially preventing the conversion of differential mode crosstalk to common mode crosstalk between (a) the third and second pairs of conductors and (b) the third and fourth pairs of conductors.

16. The plug defined in claim 15, wherein the pairs of output terminals comprise a series of generally parallel blades.

17. The plug defined in claim 15, wherein the mounting substrate is configured to maintain the positions of the second, third and fourth pairs of conductors.

18. The plug defined in claim 17, wherein the mounting substrate includes lateral capture members that capture the second and fourth pairs of conductors and a spreading member that maintains the expanded loop of the third pair of conductors.

19. The plug defined in claim 18, wherein each of the capture members includes a dividing tine that creates two separate channels, each channel receiving one of the conductors of the second and fourth pairs of conductors.

20. The plug defined in claim 18, wherein the capture members are selected from the group consisting of lateral wings and lateral troughs.

21. The plug defined in claim 18, wherein the mounting substrate further includes a slot below the spreading member that receives the first pair of conductors.

22. The plug defined in claim 18, wherein the spreading member includes a channel that receives the first pair of conductors between segments of the expanded loop of the third pair of conductors.

23. The plug defined in claim 15, wherein the first, second, third and fourth pairs of conductors are twisted wire pairs.

24. The plug defined in claim 15, wherein the width of the expanded loop of the third pair of conductors is between about 0.15 and 0.20 inches.

25. The plug defined in claim 24, wherein the length of the segments of the expanded loop of the third pair of conductors is between about 0.15 and 0.25 inches.

26. The plug defined in claim 15, wherein the segments of the expanded loop of the third pair of conductors are positioned within about 0.030 and 0.040 inches of the second and fourth pairs of conductors.

27. The plug defined in claim 26, wherein the segments of the expanded loop of the third pair of conductors are positioned about 0.050 and 0.080 inches from the first pair of conductors.

28. The plug defined in claim 15, wherein the conductors are rigid lead frame structures.

29. A mounting substrate for a communications plug, comprising:

a body formed of a dielectric material;

a spreading member mounted to an upper surface of the body, the spreading member being configured to receive one respective conductor of a differential pair of conductors on opposite sides thereof; and lateral capture members mounted to opposing edge portions of the upper surface of the body, each of the capture members being configured to receive a pair of conductors and maintain the pair of conductors at a given distance from each conductor received in the spreading member.

30. The mounting substrate defined in claim 29, further comprising a slot beneath the spreading member that is configured to receive a pair of conductors.

31. The mounting substrate defined in claim 29, wherein the spreading member includes a channel on an upper surface thereof that is configured to receive a pair of conductors.

32. The mounting substrate defined in claim 29, wherein each of the capture members includes a tine member that defines two longitudinal channels, each of the channels configured to receive one of the conductors received by the capture members.

33. The mounting substrate defined in claim 29, wherein the spreading member is configured to maintain conductors received therein at a width of between about 0.15 and 0.20 inches.

34. The mounting substrate defined in claim 29, wherein the spreading member and wings are configured such that a distance between conductors received in the spreading member and conductors received in the wings is between about 0.030 and 0.040 inches.

35. The mourning substrate defined in claim 31, wherein the spreading member is configured to maintain the conductors received therein at a distance of between about 0.050 and 0.080 inches from conductors received in the spreading member channel.

36. The mounting substrate defined in claim 30, wherein the spreading member is configured to maintain the conductors received therein at a distance of between about 0.050 and 0.080 inches from conductors received in the slot.

37. The mounting substrate defined in claim 29, wherein the capture members are selected from the group consisting of lateral wings and lateral troughs.

38. A method of preventing differential to common mode crosstalk conversion in a communications plug, the communications plug comprising a mounting substrate, a plurality of pairs of output terminals, wherein first, second and fourth pairs of the output terminals are arranged in immediately adjacent relationship, and wherein a third pair of output terminals includes output terminals that are separated from each other such that a first output terminal of the third pair is positioned between the first and second pairs of output terminals, and such that a second output terminal of the third pair is positioned between the first and fourth pairs of output terminals, the communications plug further comprising first, second, third and fourth pairs of conductors that engage the mounting substrate, each of which is attached for electrical communication with a respective one of the output terminals, the method comprising the step of:

selecting positions for segments of the conductors of the third pair of conductors adjacent the second and fourth pairs of conductors and spaced apart from the first pair of conductors such that conversion of differential mode crosstalk to common mode crosstalk from the third pair of conductors to the second and fourth pairs of conductors is substantially prevented.

39. A method of reducing differential to common mode crosstalk conversion in a communications plug, the communications plug comprising a first pair of conductors that are electrically connected to respective output terminals of a first pair of output terminals, a second pair of conductors that are electrically connected to respective output terminals of a second pair of output terminals, a third pair of conductors that are electrically connected to respective output terminals of a third pair of output terminals, and a fourth pair of conductors that are electrically connected to respective output terminals of a fourth pair of output terminals, wherein the first pair of output terminals is positioned between the third pair of output terminals, the method comprising:

selecting a position for a segment of a first conductor of the third pair of conductors adjacent the second pair of conductors and selecting a position for a segment of a second conductor of the third pair of conductors adjacent the fourth pair of conductors in order to substantially cancel differential to common mode crosstalk between the third pair of conductors and the second pair of conductors and between the third pair of conductors and the fourth pair of conductors.

40. The method defined in claim 39, wherein the third pair of conductors are positioned within the plug to include a first crossover location in which the conductors of the third pair cross each other and a second crossover location in which the conductors of the third pair cross each other.

41. The method defined in claim 40, wherein the third pair of conductors is positioned such that, between the first and second crossover locations, the third pair of conductors forms an expanded loop in which the segment of the first conductor of the third pair is closer to the second pair of conductors than it is to the first pair of conductors, and the segment of the second conductor of the third pair is closer to the fourth pair of conductors than it is to the first pair of conductors.

42. The method defined in claim 40, wherein the plug further comprises a mounting substrate that includes paths for the conductors of the third pair of conductors that route the conductors to cross over each other at the first and second crossover locations.

43. The method defined in claim 40, wherein the second crossover location is between the first crossover location and the output terminals, and wherein the conductors of at least one of the first, second or fourth pairs of conductors cross each other at a distance from one of the output terminals that is less than the distance between the third pair of output terminals and the first crossover location.

44. A communications plug, comprising:

a plurality of conductors and a plurality of output terminals, wherein a first and a second of the plurality of conductors comprise a second pair of conductors that are electrically connected to, respectively, a first and a second of the output terminals, wherein a third and a sixth of the plurality of conductors comprise a third pair of conductors that are electrically connected to, respectively, a third and a sixth of the output terminals, wherein a fourth and a fifth of the plurality of conductors comprise a first pair of conductors that are electrically connected to, respectively, a fourth and a fifth of the output terminals, and wherein a seventh and an eighth of the plurality of conductors comprise a fourth pair of conductors that are electrically connected to, respectively, a seventh and an eighth of the output terminals; and a mounting substrate that receives each of the plurality of conductors, wherein the first through eighth output terminals are aligned in numerical order, wherein the mounting substrate defines a first crossover region where the third and sixth conductors cross each other a first time and a second crossover region where the third and sixth conductors cross each other a second time.

45. The communications plug of claim 44, wherein between the first and second crossover regions, the third of the plurality of conductors is positioned closer to the fourth pair of conductors than to the second pair of conductors, and between the first and second crossover regions, the sixth of the plurality of conductors is positioned closer to the second pair of conductors than to the fourth pair of conductors.

46. The communications plug of claim 44, wherein the conductors of the first pair of conductors cross over each other at a portion of the first pair of conductors that is received by the mounting substrate.

47. The communications plug of claim 44, wherein the conductors of the second pair of conductors cross over each at a third crossover location and the conductors of the fourth pair of conductors cross over each other at a fourth crossover location, and wherein the third and fourth crossover locations are closer to the output terminals of the plug than at least one of the first and second crossover regions.

48. The communications plug of claim 44, wherein the distance between the third and sixth conductors halfway between the first and second crossover regions is equal to or greater than the distance between the third and sixth output terminals.

49. The communications plug of claim 44, wherein the third and sixth conductors form an expanded loop between the first crossover region and the second crossover region.

50. A communications plug, comprising:

a plug body that is attached to a communications cable;

first through eighth output terminals mounted in the plug body and aligned in a side-by-side relationship in numerical order;

first through eighth conductors mounted within the plug body that are electrically connected to the first through eighth output terminals, respectively;

wherein the fourth and fifth conductors form a first pair of conductors, wherein the first and second conductors form a second pair of conductors, wherein the third and sixth conductors form a third pair of conductors, wherein the seventh and eighth conductors form a fourth pair of conductors wherein the third and sixth conductors cross over each other at first and second crossover locations within the plug body, and wherein, between the first and second crossover locations, the distance between the third and sixth conductors is greater than the distance between the fourth and fifth conductors.

51. The communications plug defined in claim 50, wherein the fourth and fifth conductors cross over each other at a third crossover location within the plug body.

52. The communications plug defined in claim 50, wherein the first and second crossover locations are located between an end of a jacket of the communications cable and the first through eight output terminals.

53. The communications plug defined in claim 50, wherein the first and second conductors further cross over each other at a third crossover location within the plug body, and wherein the seventh and eight conductors further cross over each other at a fourth crossover location within the plug body.

54. The communications plug defined in claim 50, wherein the distance between the third and sixth conductors halfway between the first and second crossover locations is greater than or equal to the distance between the third and sixth output terminals.

55. The communications plug defined in claim 51, wherein between the first and second crossover locations, the third of the plurality of conductors is positioned closer to the fourth pair of conductors than to the second pair of conductors and the sixth of the plurality of conductors is positioned closer to the second pair of conductors than to the fourth pair of conductors.

* * * * *

UNITED STATES PATENT AND TRADEMARK OFFICE

CERTIFICATE OF CORRECTION

PATENT NO. : 7,220,149 B2
APPLICATION NO. : 11/051305
DATED : May 22, 2007
INVENTOR(S) : Pharney It is certified that error appears in the above-identified patent and that said Letters Patent is hereby corrected as shown below:

In The Claims:

Column 11, Claim 35, Line 66: Please correct "mourning"
To read -- mounting--

Signed and Sealed this

Thirty-first Day of July, 2007

JON W. DUDAS
*Director of the United States Patent and Trademark Office*